United States Patent [19]

Tesch

[11] Patent Number: 4,959,880

[45] Date of Patent: Oct. 2, 1990

[54] PILLOW HAVING A REMOVEABLE INSERT

[76] Inventor: Günter Tesch, Avenue Jean-Marie-Musy 15, Fribourg, Switzerland, CH-1700

[21] Appl. No.: 407,955

[22] Filed: Sep. 15, 1989

Related U.S. Application Data

[63] Continuation of Ser. No. 174,969, Mar. 29, 1988, abandoned.

[30] Foreign Application Priority Data

Apr. 7, 1987 [CH] Switzerland ..... 134187

[51] Int. Cl.[5] ..... A47C 20/02

[52] U.S. Cl. ..... 5/434; 5/490; 5/442; 5/437

[58] Field of Search ..... 5/434, 490, 491, 492, 5/462, 485, 442, 436, 437

[56] References Cited

U.S. PATENT DOCUMENTS

| | | | |
|---|---|---|---|
| 655,790 | 8/1900 | Long | 5/491 |
| 2,234,506 | 3/1941 | Sistig | 5/436 |
| 3,139,632 | 7/1964 | Johns | 5/485 |
| 3,148,389 | 9/1964 | Lustig | 5/434 |
| 3,459,179 | 8/1969 | Olesen . | |
| 3,842,453 | 10/1924 | Redfield | 5/436 |
| 3,863,283 | 2/1975 | Mohr | 5/442 |
| 3,987,507 | 10/1976 | Hall | 5/437 |
| 4,247,961 | 2/1981 | Masch et al. | 5/434 |
| 4,277,859 | 7/1981 | Seaman | 5/434 |
| 4,365,371 | 12/1982 | Boussaroque | 5/462 |
| 4,606,088 | 8/1986 | Milhaelsen et al. | 5/434 |
| 4,688,286 | 8/1987 | Miker, Jr. | 5/434 |
| 4,712,259 | 12/1987 | Chiasson | 5/441 |
| 4,768,248 | 9/1988 | O'Sullivan | 5/442 |

FOREIGN PATENT DOCUMENTS

| | | | |
|---|---|---|---|
| 1023202 | 1/1958 | Fed. Rep. of Germany | 5/485 |
| 1108303 | 9/1954 | France . | |
| 117247 | 10/1926 | Switzerland . | |
| 931649 | 7/1963 | United Kingdom | 5/462 |
| 999217 | 7/1965 | United Kingdom | 5/434 |
| 1472559 | 5/1977 | United Kingdom | 5/485 |
| 2134383 | 3/1983 | United Kingdom . | |

*Primary Examiner*—Eric K. Nicholson

*Attorney, Agent, or Firm*—Bacon & Thomas

[57] ABSTRACT

A cushion, in particular a pillow or the like, containing a filling is described, which is characterized in that the filling comprises in addition to materials for the intended use of the pillow, such as down, feathers, fibers, balls of fibers, foam particles or the like, certain components which may be removed prior to the intended use of the pillow. The removable components may consist of a filled insert or a cardboard insert enclosing a hollow space. The insert may consist of a bag. The insert may be filled with filler materials other than those in the remainder of the pillow.

6 Claims, 1 Drawing Sheet

PILLOW HAVING A REMOVEABLE INSERT

This application is a continuation, of application Ser. No. 174,969, filed Mar. 29, 1988 now abandoned.

FIELD OF THE INVENTION

The invention concerns a cushion, in particular a pillow or the like, with a filling. Pillows are frequently purchased on the basis of their external appearance; i.e., the customer inspects the pillow and evaluates its quality and in particular the volume of the filling, by whether the case is bulging or sunken in. In most cases, the customer does not try the pillow to determine whether he would be sleeping well on it.

Many persons sleep on highly stuffed pillow less well than on pillows with less filling.

SUMMARY OF THE INVENTION

It is the object of the present invention to provide a pillow of this generic type, which at the time of sale always has a "highly stuffed" appearance, but which contains only enough filling for wholesome sleep.

This object is attained by the invention. The pillow according to the invention has a filling which contains, in addition to the materials intended for use in the pillow (such as down, feathers, fibers, balls of fibers, foam particles or the like), certain components that may be removed prior to the intended use of the pillow.

The removable components should have shapes such that they are noticed during the intended use of the pillow. This may be obtained for example if the material rustles when a head settles into it. But the material of the removable components may for example also be harder than the rest of the material, so that the pillow appears to be too hard when it is in use. The essential condition is that the user must be made aware of the fact that there is something in the pillow that must be removed.

According to a particular form of embodiment, the removable components consist of an insert, preferably filled. Such an insert is readily removed from the pillow, if the pillow case is provided with a closable opening.

The removable components may be formed by a cardboard insert enclosing a hollow space. This cardboard insert may be empty, i.e., contain air only.

A further simple insert merely consisits of a bag. The bag may be made of a fabric, a nonwoven fabric or a plastic net, such as marketed under the designation "XIRONET" by the XIRO AG Co. CH-3185 Schmitten.

The separation between the pillow and insert may be formed by an inner pocket, wherein the latter may also utilize the pillow case as a boundary. This inner pocket may again consist of a woven fabric, a nonwoven fabric or a plastic net. The pocket should be made of a material that is essentially impermeable to the other materials.

However, the insert may also be filled with different objects. These may consist of the materials constituting the rest of the filling of the pillow, and they may for example be more tightly packed in the insert than in the rest of the pillow. The insert then serves for example as a refill pack for the pillow filling itself. The insert may thus be filled with fiber balls which may be used to refill the pillow with additional fiber balls follwoing the removed of the insert, until, the desired hardness and/or filling is obtained.

However, the insert and/or inner pocket may also be used to conceal certain objects. The inner pocket and/or insert may thus be designed to receive foreign objects to be hidden and to be later worn on the body, such as jewelry, ear plugs, condoms for men, or the like. The pillow then serves as a hiding place for certain objects. A small alarm clock may also be such an object.

The insert or inner pocket may also be filled with filler materials other than those of the remainder of the pillow.

Advantageously, the casing directly enclosing the filling has an opening closable, for example, with a zip fastener, velcro fastener, or the like.

Preferably, the filler materials in the insert are essentially spherical fiber aggregates and preferably the other filler materials of the cushion also consist of such fiber aggregates.

The design of the pillow with removable components which interfere with its use, also directs the attention of the user to the fact that he may open the pillow very easily himself. He then may further find therein instructions explaining the use of this, special, refillable pillow, which may also be emptied in this manner.

DETAILED DESCRIPTION OF THE DRAWINGS

A pillow 1 according to the invention comprises a casing 2 having a closeable opening 3. The opening 3 may be closed by any known closing means, for example, a zip fastener, a velcro fastener, or the like.

Figure 1:
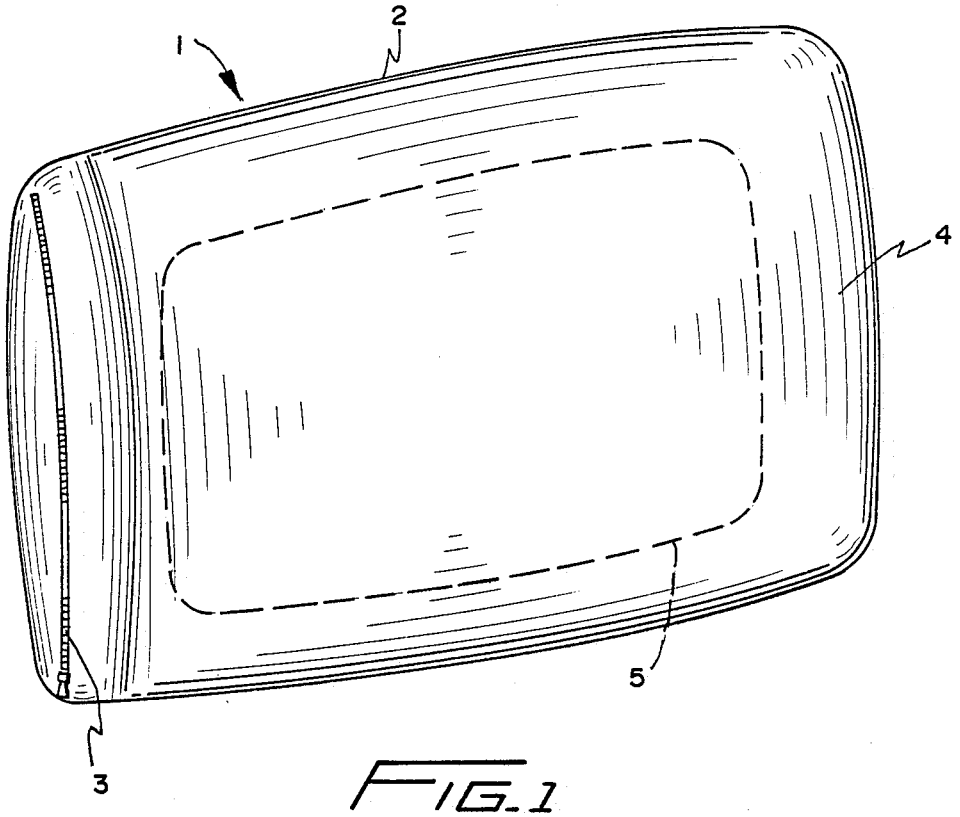
FIG. 1 is a cross-sectional view of a pillow according to the invention.

The interior 4 of the pillow 1 may be suffed with individual filler materials comprised of down, feathers, fiber, balls of fiber, foam particles or the like. Further located in the interior 4 of the pillow 1 as shown in FIG. 1 is a removeable insert 5.

Figure 2:
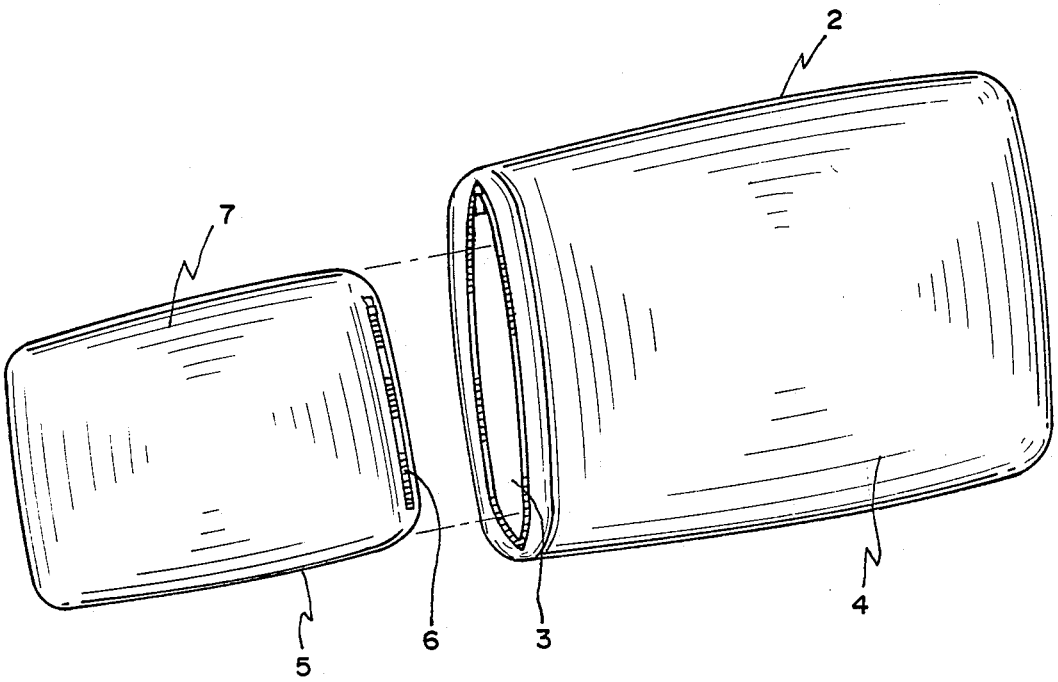
FIG. 2 is a side view separately showing the pillow and insert.

In the preferred embodiment the removeable insert 5 comprises a inner bag or container which, like the pillow 1 itself, may be comprised of a material such as a fabric, a nonwoven fabric or a plastic net. As best shown in FIG. 2, the removeable insert 5 has a closeable opening 6 which provides access to the interior 7 of the insert. The closeable opening may also include closure means known in the art such as zip fastener, a velcro fastener or the like. In the preferred embodiment of the invention, the interior area 7 of the removeable insert 5 is stuffed with the same filler located within inner area 4 of pillow 1 i.e. loose, individual filling elements comprised of down, featers, fibers, balls of fiber, foam particles or the like. The filler material within inner area 7 of insert 5, however, is more densely packed than the filler material in the inner area 4 of the casing 2.

It is intended that the pillow 1 be sold with the more highly densely packed removeable insert 5 located within the inner area 4 of casing 2 such that, prior to use, the insert 5 may be removed from the casing 2 such that the individual filling elements in the insert 5 may be transferred to the inner area 4 of the casing 2 or vice-versa in order for the user to adjust the firmness of the pillow to a desired level.

I claim:

1. A pillow comprising a casing having at least one closeable opening which provides access to an inner area of said casing, filler materials in said inner area comprised to loose, individual filling elements and an insert, said insert comprising a container having at least one closeable opening which provides access to an inner area of the insert, said inner area of said insert containing sufficient loose, individual filling elements to produce an insert having a higher density than the inner area of said casing, said insert being removable from said casing such that the individual filling elements in said insert may be transferred to the inner area of said casing and vice-versa in order to adjust the firmness of said pillow.

2. A pillow as claimed in claim 1 wherein the individual filling elements in the casing comprise elements selected from one of the following groups: down, feathers, fiber balls and foam particles.

3. A pillow as claimed in claim 2 wherein the insert is filled with the same type of filler materials as the inner area of said casing.

4. A pillow as claimed in claim 2 wherein said loose, individual filling elements in the inner area of said casing and insert are made of the same material.

5. A pillow as claimed in claim 1 wherein the container comprises a bag having a recloseable opening.

6. A pillow as claimed in claim 1 wherein the container comprises a carboard insert.

* * * * *